US006162377A

United States Patent [19]

Ghosh et al.

[11] Patent Number: 6,162,377

[45] Date of Patent: Dec. 19, 2000

[54] APPARATUS AND METHOD FOR THE FORMATION OF UNIFORM SPHERICAL PARTICLES

[75] Inventors: Debabrata S. Ghosh, Calgary; Kristian P. Olsen, Edmonton, both of Canada

[73] Assignee: Alberta Research Council Inc., Edmonton, Canada

[21] Appl. No.: 09/255,862

[22] Filed: Feb. 23, 1999

[51] Int. Cl.[7] ..... B29B 9/10

[52] U.S. Cl. ..... 264/9; 264/12; 264/14; 425/6; 425/7; 425/10

[58] Field of Search ..... 264/9, 11, 12, 264/13, 14; 425/6, 7, 10

[56] References Cited

U.S. PATENT DOCUMENTS

| | | | |
|---|---|---|---|
| 4,035,116 | 7/1977 | O'Brien et al. | 264/9 |
| 4,801,411 | 1/1989 | Wellinghoff et al. | 264/9 |
| 4,871,489 | 10/1989 | Ketcham | 264/9 |
| 4,935,173 | 6/1990 | Huey et al. | 264/14 |

*Primary Examiner*—Mary Lynn Theisen
*Attorney, Agent, or Firm*—Freedman & Associates

[57] ABSTRACT

The present invention relates to an atomization apparatus and method for the formation of substantially uniform, at least nearly spherical particles, particularly for the formation of metal particles. The present invention provides an atomization apparatus having a nozzle positioned at the bottom of a cooling chamber. Rayleigh wave instability may be induced by imparting vibrations to a stream of molten material which is released in an upward direction. This produces uniform droplets having an initial velocity sufficient to increase the residence time of the droplets in an inert atmosphere. The parabolic trajectory of the droplets over a 2 m vertical displacement is approximately five times longer than a freefall, thus significantly increasing the cooling time without increasing the cooling chamber height. Further the kinetic energy of each droplet is much lower throughout its trajectory which serves to improve the formation of spherical shaped particles and to lower the impact velocity. Vibrations imparted to the nozzle transversely to the fluid stream cause a periodic dispersion of the sequential droplet trajectories preventing droplets from impacting each other or coalescing.

23 Claims, 5 Drawing Sheets

APPARATUS AND METHOD FOR THE FORMATION OF UNIFORM SPHERICAL PARTICLES

FIELD OF THE INVENTION

The present invention relates to an apparatus and method for atomizing a molten liquid to form particles or granules of at least nearly spherical shape and substantially uniform size, particularly for the formation of relatively large metal particles.

BACKGROUND OF THE INVENTION

Spherical particles have increasing applications in industrial processes. Spherical particles provide good flowability, low surface area and hence a minimum of surface oxide, and efficient packing. Applications for relatively large particles, approximately 200 microns to 5 mm, of uniform size, such as Thixomolding™ of alloys, and other applications in ceramics, ceramic metal combinations, metals and metal alloys provide a demand which is presently not fully satisfied. Current practices for the formation of large particles are expensive, and do not provide the level of shape, uniformity and purity demanded.

A common prior art practice is disclosed in U.S. Pat. No. 4,428,894 by Bienvenu issued in 1984 in the name of Extramet. A jet of molten metal is passed through a vibrating orifice. Drops formed fall from the orifice under the action of gravity through an inert gas atmosphere at a cooling temperature. If particles larger than one millimeter in diameter are to solidify to a point where sphericity is maintained after impacting the bottom, an extremely tall cooling tower is required. This cooling tower method also causes the droplets to pass through the inert atmosphere at high relative velocity, approximately 20 meters per second. In a technique called "double fluid atomization" a high pressure gas flow is introduced causing an even higher relative velocity. High relative velocity, it has been found, distorts the spherical shape of the droplets. In addition impact with the chamber walls prior to solidification, or impact with the bottom of the cooling tower if a quench liquid is not used, flattens the particles unless the cooling tower is sufficiently tall. When quench liquids are used to remove significant latent heat, droplets that are still liquid or semi-solid can lose their spherical shape upon impact with the quench liquid. Thus even with a quench liquid, residence time in a cooling tower must still be maximized in order to permit droplets to cool sufficiently to reduce deformation.

Other factors which adversely affect particle shape include agglomeration with other droplets prior to solidification which affects the shape and size distribution of particles. Since individual droplets spheroidize from a ligand shape caused by the breakup of a liquid stream, a particular problem in the case of high melting point materials is that solidification can occur prior to spheroidization of the droplet causing irregularly shaped particles. A further problem is associated with surface oxidation. Oxides normally have a much higher melting point, and for skin-forming alloys like aluminum, this layer forms almost immediately and can make spheroidization impossible. Oxidation, it is known, can be reduced by providing an inert gas atmosphere within the cooling tower. Since a cooling tower can be 20 meters high, circulating a cooling inert atmosphere throughout can be quite expensive.

Control of particle size distribution is also important to particle production. Uniform particles are easier to model in applications such as Thixomolding™ or alloying. Use of a Rayleigh wave disturbance to impart predetermined, vibration induced break up of an unstable liquid stream has been used extensively to control the formation of uniform droplets.

Most metals and alloys are more reactive in the molten state than in the solid state. As a result, it is desirable to make the time a droplet spends in molten state as short as possible. Commonly, in prior art practices, this is accomplished by quenching the droplets in a fluid with a high heat transfer coefficient, as soon as spheroidization has occurred. However, often an undesired reaction occurs between the particle surface and the quench liquid. For a highly reactive alloy, such as magnesium, this would cause unacceptable contamination. It is necessary for reactive metals to maximize the time spent cooling in an inert gas, that is the residence time, before removing the bulk of latent heat with a quench liquid, otherwise particles may be contaminated through chemical bonding with other materials. Thus, for large particles holding significant latent heat, maximizing cooling time requires a very tall, and expensive, cooling tower.

U.S. Pat. No. 4,871,489 by Ketcham, issued to Coming Incorporated in 1989, discloses the use of an inverted apparatus produced by Thermo Systems Incorporated for the production of metal oxide precursors. This apparatus is designed for the production of very fine particles, having a diameter of about 8.5 microns and not larger than 50 microns. Fluid is forced though a thin perforated plate to form a plurality of fluid streams. Oscillation of the plate is applied in the direction of the fluid flow to break up uniform droplets. The droplets are entrained in the flow of a dispersion medium which dries and removes the light particles. However, this device is not adequate for the formation of larger particles which have greater latent heat and kinetic energy. Sufficient cooling would not occur as particles are entrained in the dispersion fluid. The flow of dispersion fluid necessary would be rapid to lift the heavy particles from the chamber, which would adversely affect the particle shape. In addition, the greater latent heat and longer cooling time would lead to increased particle agglomeration as still molten particles contact one another in the dispersion flow. This patent does not teach a method for increasing the residence time for the formation of large uniform and spherical particles.

It is desired to provide relatively large uniform and spherical particles, without reactive contaminants. A more economical apparatus is needed, suitable for highly reactive materials which would reduce distortion of particle size and shape. It is proposed to provide an inverted cooling chamber that releases a molten stream at or near the bottom to launch large particles on a parabolic trajectory having an upward and downward path. This provides a longer cooling time in a controlled atmosphere at low relative velocity without the large cooling tower currently required by the prior art.

SUMMARY OF THE INVENTION

The present invention has found that a liquid stream positioned near the bottom of a cooling chamber can employ the droplet initial velocity to increase the residence time in the inert gas, thus significantly increasing the cooling time without increasing the chamber height. A much smaller cooling chamber is needed as the droplets can be shown to spend approximately five times longer on its trajectory than a gravity fall in the cooling atmosphere. Further, the kinetic energy of each droplet is much lower throughout its trajectory than prior art processes, which serves to improve the formation of spherical shaped particles and to lower the impact velocity. Vibrations imparted transversely to the fluid stream cause a periodic dispersion of the droplet stream into different trajectories preventing droplets from impacting each other or coalescing. Rayleigh wave disurbance can further be used to provide uniform droplet size.

In accordance with the invention there is provided a method of forming particles of at least nearly spherical shape in an atomization apparatus comprising the steps of:

releasing a stream of molten material through an aperture under positive pressure upward into a cooling chamber where the stream breaks up into substantially spherical droplets;

whereby the stream is released under sufficient pressure that the droplets have a kinetic energy sufficient to follow an upward trajectory above the aperture and a descending return path with a duration sufficient to harden the material to a point where the droplet shape will not be substantially changed on impact with a collecting area of the cooling chamber.

In accordance with a further aspect of the invention there is provided an atomization apparatus for the formation of particles of at least nearly spherical shape from molten material comprising:

a vessel for containing a material at a molten state;

pressurization means for applying positive pressure to at least a portion of the molten material in the vessel;

a cooling chamber;

at least one aperture contained in the cooling chamber communicating with the vessel for releasing a stream of the molten material under pressure upwards into the cooling chamber where it will break up into substantially spherical droplets;

the cooling chamber further including a top above the at least one aperture dimensioned to permit each of the droplets released to follow an upward trajectory and to fall on a return path to a collection area of the cooling chamber, the collection area being disposed be low the top of the cooling chamber, for collecting the formed particles.

It is an advantage of the method in accordance with the present invention that particles of improved size uniformity and shape characteristics are produced.

Advantageously, the apparatus in accordance with the present invention is significantly smaller than equivalent prior art structures, requiring less gas to provide an inert atmosphere, and less space to produce the same quantity of product, particularly for the production of large particles.

Additional advantages will be understood to persons of skill in the art from the detailed description of preferred embodiments, by way of example only, with reference to the following figures:

BRIEF DESCRIPTION OF THE DRAWINGS

Like numerals are used throughout to indicate like elements.

DETAILED DESCRIPTION OF PREFERRED EMBODIMENTS

Figure 1:
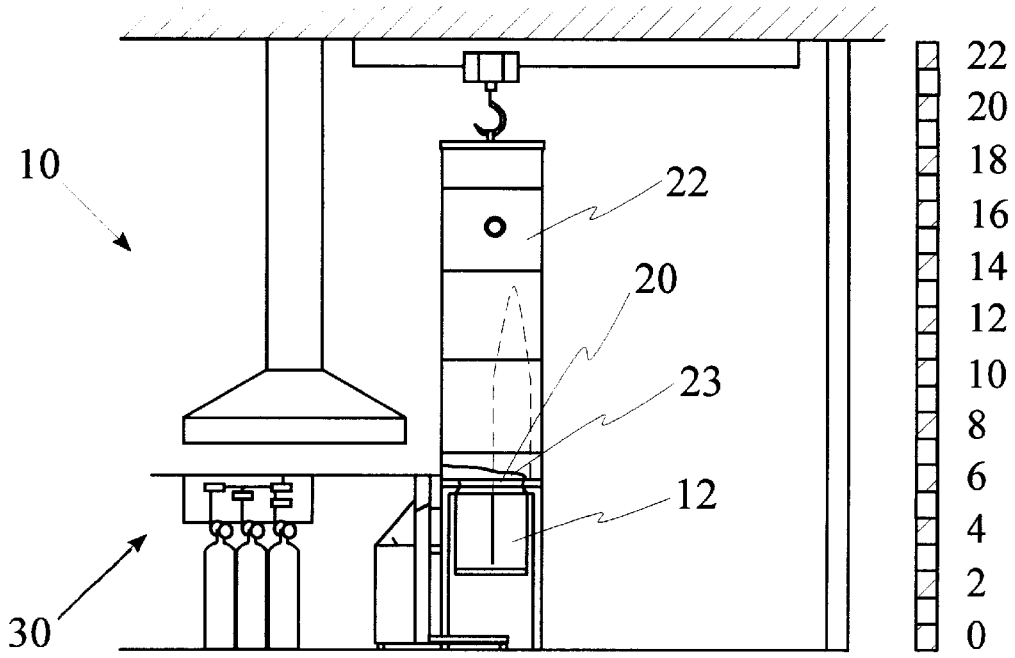
FIG. 1 is a schematic illustration of an inverted stream apparatus for the production of solid particles from molten materials, in accordance with the present invention.

The apparatus in accordance with the present invention is shown generally at 10 in FIG. 1. A containment vessel 12 surrounds a furnace 14 and crucible 16. The containment vessel is charged with solid material. Furnace 14 heats the crucible 16 until the material becomes molten. Molten material within the containment vessel 12 is held under pressure up to approximately as much as 200 kPa. The pressure may be generated by pumping an inert gas into the vessel, or an accumulator may be used to pressurize a small volume of molten material at a time. Other pressurization techniques known in the art may also be used. Molten material under pressure is allowed to pass through a transfer tube 18 (seen more clearly in FIG. 4) to a capillary nozzle 20. Liquid is released upward through the nozzle 20 as a fine stream. Vibration applied to the nozzle 20 from vibration unit 24 causes a Rayleigh wave disturbance to break up the fluid stream into uniform droplets. In addition, oscillation of the nozzle 20 occurs in a transverse direction to the direction of the molten stream laterally displacing the nozzle 20 and causing sequential droplets to leave the nozzle 20 on different trajectories. This assists in preventing collisions of the droplets or particles in flight. Conveniently vibration from the vibration unit 24 can impart wave disturbance and oscillation to the nozzle 20 simultaneously. Wave disturbance, however, can be caused by imparting vibration to the fluid through a number of different techniques known in the art. If uniform size is not required, the stream will break up into substantially spherical particles without imparting a Rayleigh wave instability. Similarly the droplet trajectories may be separated by other means such as through the use of a dispersion gas, or by causing a charge to be carried by the droplets.

Figure 6:
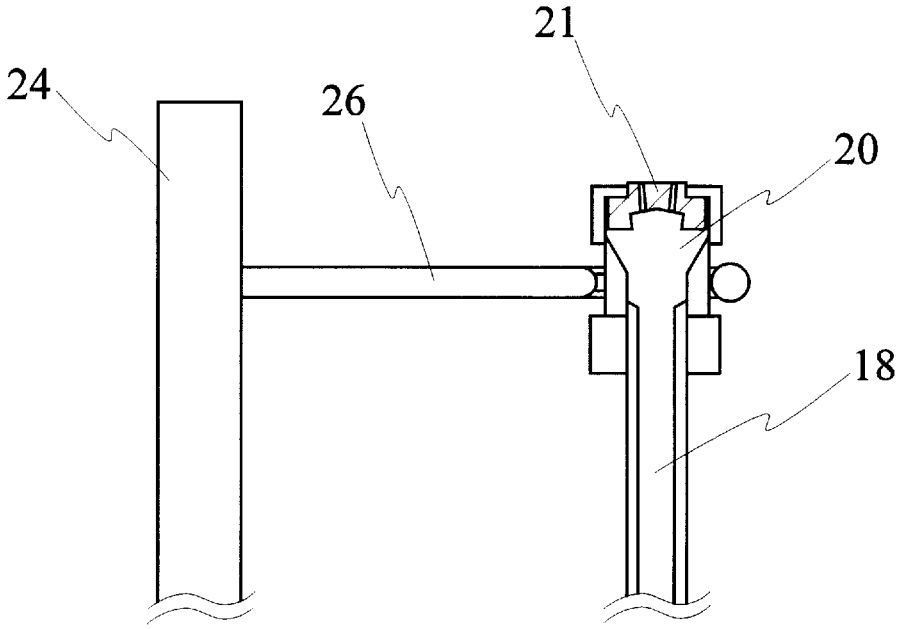
FIG. 6 is a schematic illustration of a dual orifice nozzle.

The size of the particles formed is dependent on the aperture diameter in the nozzle 20 and the frequency of the imparted vibrations. An aperture diameter is expected to be approximately 50% of the formed particle diameter. The vibration unit 24 is an audio speaker voice coil capable of generating an oscillation frequency from 10 Hz to 6 kHz and a maximum displacement of approximately 1 mm. Other frequency controlled vibration transducers can also be used. For very fine particles, frequencies of up to 50 kHz are required, and other means for applying a transverse oscillation would be necessary. The aperture 21, an orifice or capillary in the nozzle 20 is oriented at a small angle (seen more clearly in FIG. 6) to the vertical for launching the droplets on a parabolic trajectory which impacts a collecting area 23 at the bottom of the cooling chamber 22 a distance from the nozzle 20, preventing collisions between droplets in ascending and descending paths of their trajectories. An angle of approximately 5 to 10 degrees is anticipated. The angle is constrained by the maximum horizontal travel accommodated within the cooling chamber 22.

The droplets rise in a cooling chamber 22 which is provided with a controlled atmosphere from a gas control system shown generally at 30. The pressure of the molten fluid is controlled to select a trajectory height for the droplets before the return fall. The trajectory provides sufficient residence time for the droplets to form a skin solid enough to retain its shape during the fall and impact. Particles are collected from a collection area 23. To maximize cooling time in the cooling chamber 22, this is usually at a level with the nozzle 20 or below the nozzle 20. However, a collection area could be at a higher level within the cooling chamber to take advantage of the low kinetic energy of the descending particles.

The gas control system circulates a gas atmosphere to maintain a constant temperature. The atmosphere is often an inert gas to prevent reactions and unwanted oxidation of the particles. In some cases, for instance in the production of ferrous materials, a reactive atmosphere can be provided within the cooling chamber 22 to promote mass transfer during the more reactive molten state. A heat exchanger (not shown) may be incorporated in the gas circulation system outside the cooling chamber 22. The atmospheric circulation may comprise a cooling counter flow from the top of the cooling chamber 22, thus providing a cooling temperature gradient for spheroidization prior to solidification. A vacuum pump and release valve may be incorporated to maintain a constant pressure and coolant flow within the cooling chamber 22. The nozzle 20 and transfer tube 18 are heated and insulated to retain heat. Additionally, convection currents from the transfer tube heater rise upward to the exposed nozzle top, where one or more apertures 21 release the liquid stream.

Figure 7:
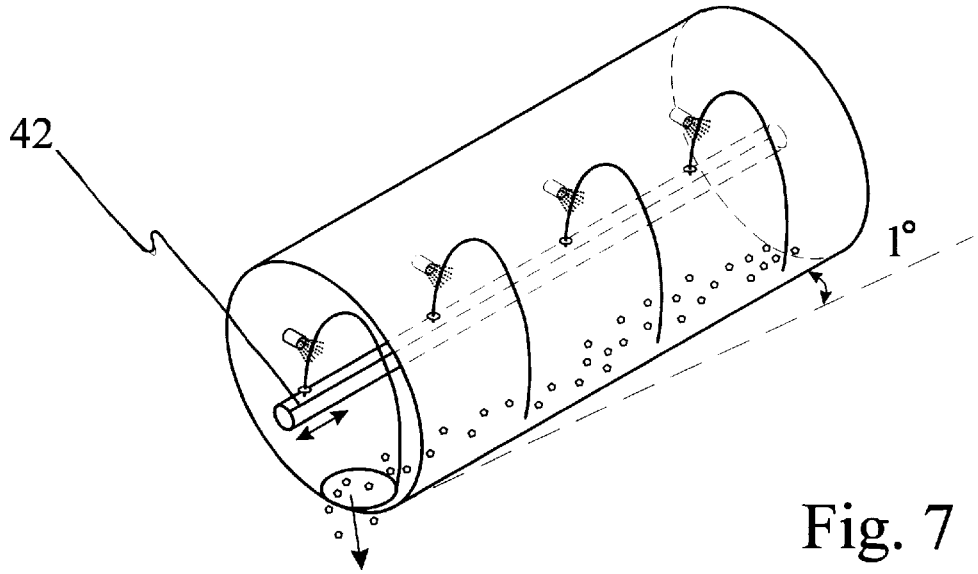
FIG. 7 is a schematic illustration of an alternative embodiment of the present invention including a plurality of nozzles; and, FIG. 8 is an end view of the embodiment illustrated in FIG. 7.
Figure 8:
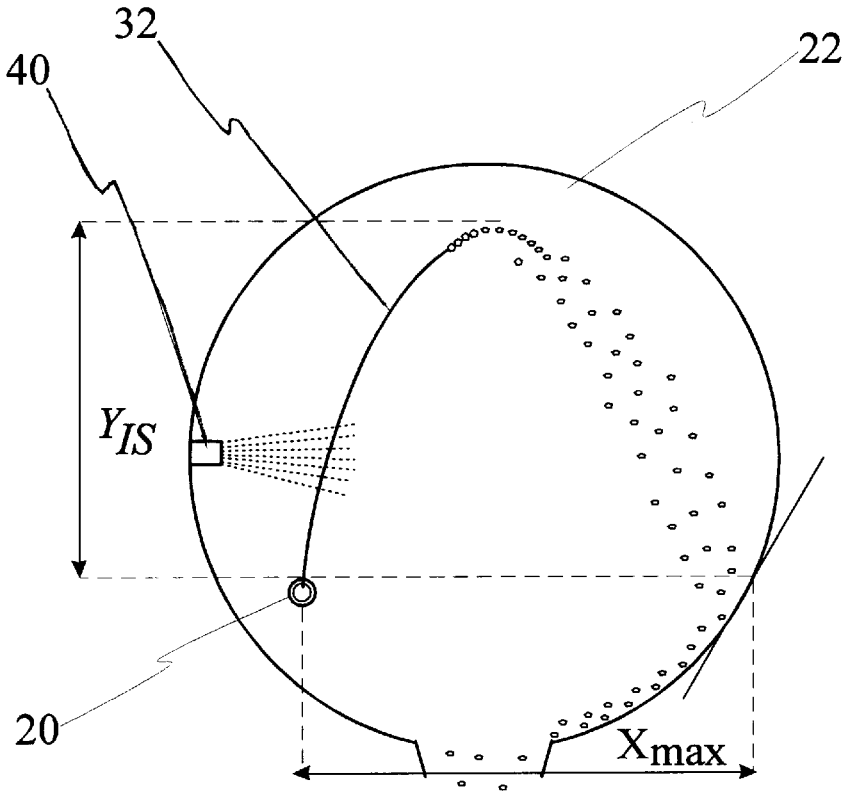

Advantageously, a plume of atomized argon vapor is introduced to provide significant cooling without disrupting the particle formation. As illustrated in FIGS. 7 and 8, the argon plume impinges transversely on the molten stream below the trajectory azimuth. The angle of the coolant plume against the molten stream can be modified. The plume impinges on the stream where it is still stable and therefore does not affect the stream instability or the formation of the particle shape. This provides effective cooling without affecting the droplet shape. This is unlike prior art gas flow atomization techniques, where gas flow induces atomization but the high relative velocity disrupts particle shape. Evaporation of the argon from vapor phase absorbs significant latent heat, while the use of argon at −186 degrees C introduces a large temperature differential into the cooling chamber which increases the rate of cooling. As a result, the trajectory height and therefore the cooling chamber height can be further reduced. A positive pressure is maintained within the cooling chamber 22 of approximately 5–15 kPa which permits an increased volume flow of coolant. An additional advantage is that the argon expansion from atomized vapor to gas assists in displacing, in particular, lighter oxygen and nitrogen from the cooling chamber, which may be introduced through leaks.

A cooling plume of atomized nitrogen vapor, helium vapor, carbon dioxide vapor or other liquefied gas could also be used. The plume is injected as a vaporized liquid which will change to gas entering the elevated temperature of the cooling chamber 22. Depending on the temperature at the plume orifice 40 and the coolant used, the plume may be a vapor plume, a mixture of vapor and gas, or only gas impinging on the molten stream.

A coolant vapor plume also provides a vehicle for introducing other material into the atomization process. For instance the coolant can be mixed with a protective gas, such as sulfur hexafluoride to surround the molten stream and assist in preventing reactions with the molten stream in the cooling chamber atmosphere. Alternatively, a fine solid material, such as powder or wisker material can also be introduced with the coolant plume to combine with the molten material. Ceramic solids such as aluminum oxide, titanium oxide, zirconium oxide or magnesium oxide, silicon nitride or silicon carbide, tungsten carbide, titanium carbide, halfnium carbide or vanadium carbide are used with metals to form composite materials with specific characteristics. By introducing these materials at a controlled rate into the molten stream, particles with more precisely controlled compositions can be formed.

Figure 2:
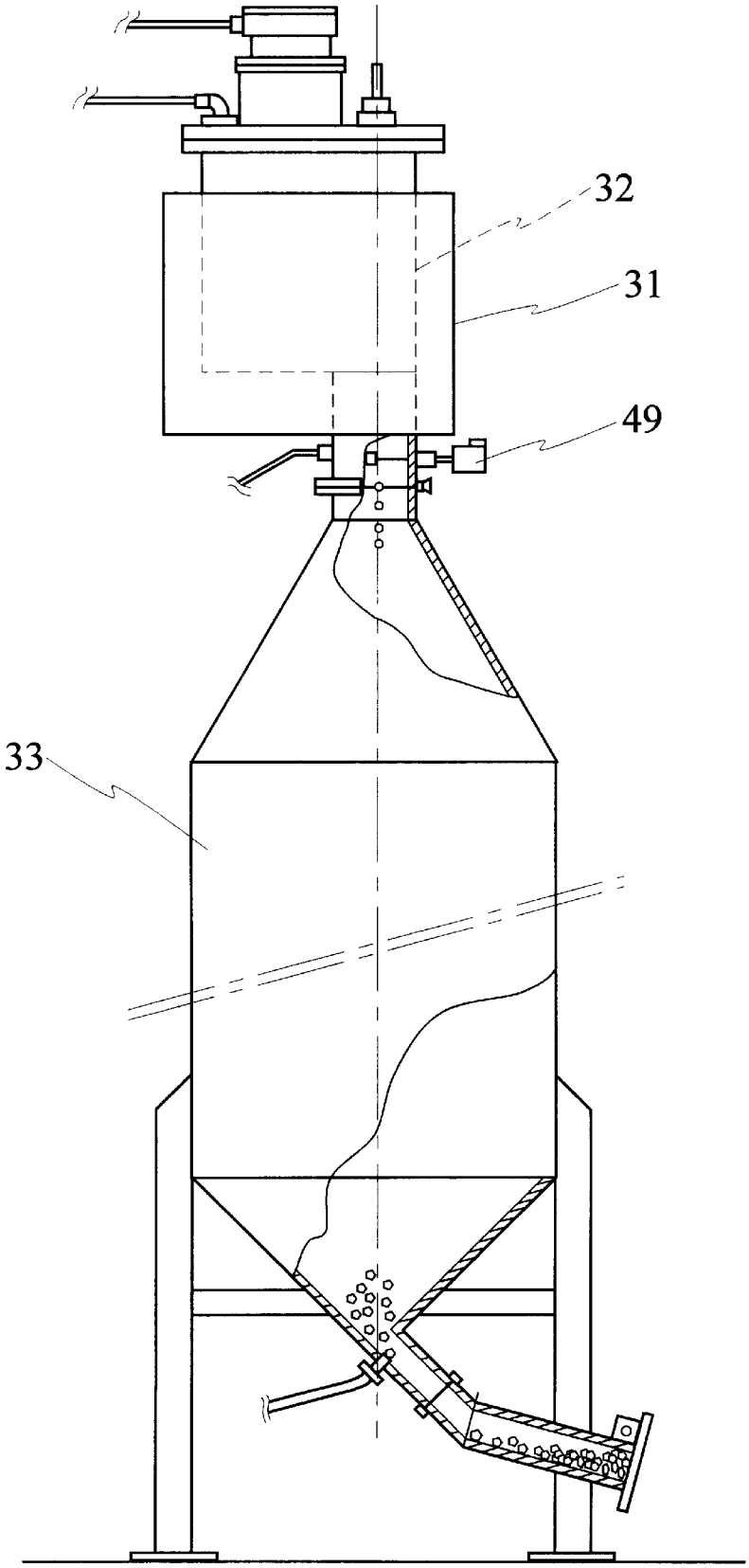
Fig. 2 (Prior Art)
FIG. 2 is a schematic illustration of a prior art cooling tower.

By contrast, a typical cooling tower as used in the prior art is shown in FIG. 2. A furnace 31 surrounds a gas-tight cell 32 above a tower 33. A transfer tube provides communication between the cell 32 and the tower 33. A vibrator 49 acts on the tube and causes division of the jet into liquid drops as it passes through the orifice. The drops fall into the tower 33 filled with an inert gas. The height of the tower is sufficient to ensure that the drops of liquid metal solidify while falling. This may be as high as 20 meters.

Figure 3A:
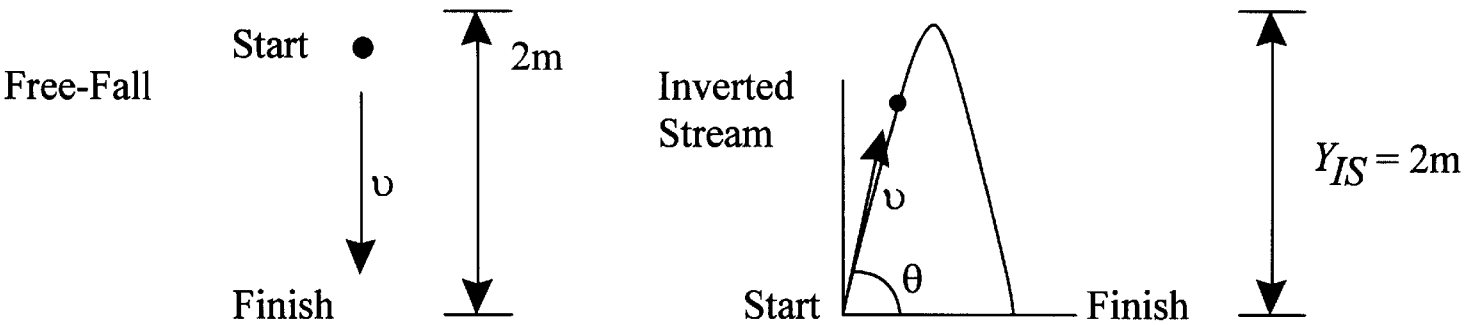
FIG. 3A is a graphic illustration of both a gravity freefall trajectory in accordance with the prior art, and an inverted stream trajectory in accordance with the present invention.

Looking at FIG. 3A it is possible to compare a frictionless free fall as an approximation of a residence time for a particle to travel within a vertical drop cooling tower.

$$t_{freefall} = \frac{-v_0 - \sqrt{v_0^2 + 2gy}}{g}$$

with $\upsilon_0$=−6.3 m/s, y=−2 m, and g=−9.81 m/s$^2$, $t_{freefall}$=0.26 seconds.

In the inverted stream case in accordance with the present invention, the equation is as follows:

$$t_{inverted} = \frac{2v_0 \sin(\theta)}{g}$$

with =88° and $\upsilon$=6.3 m/s, $t_{inverted}$=1.3 seconds.

This is about 5 times longer than the first equation. Note that the maximum height obtained by the inverted stream, $y_{IS}$ is given by the following equation:

$$y_{IS} = \frac{(v_0 \sin\theta)^2}{2g}$$

given that $\upsilon_0$=6.3 m/s and g=−9.81 m/s$^2$ the result is $y_{IS}$=2.0 m.

Figure 3B:
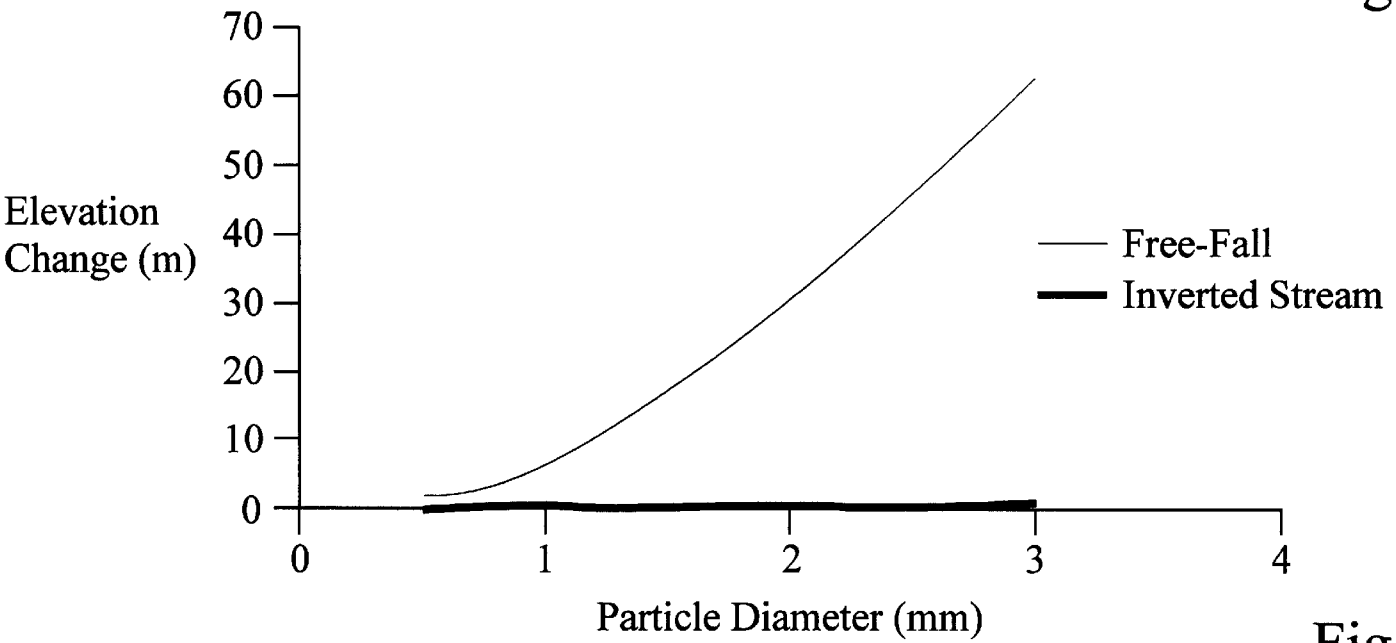
FIG. 3B is a graph modeling a minimum cooling tower height for both freefall and inverted stream trajectories.

Therefore with a similar-sized atomization tower, the residence time of a liquid droplet can be greatly increased over a gravity-fed apparatus. The comparison is graphically illustrated in FIG. 3B showing the elevation a cooling chamber must accommodate for free fall and inverted stream trajectory in accordance with the present invention, for sufficient cooling to produce granules of desired shape and purity. The model shown in FIG. 3B is based upon Newtonian cooling of a magnesium droplet in helium gas. The model incorporates the effects of particle drag, but assumes a constant temperature difference between the droplet and the gas. As can be seen the difference in minimum height can be an order of magnitude with larger particles.

Not only is the cooling time increased, the relative velocity of droplets to the surrounding atmosphere is also reduced in accordance with the present invention to no greater than approximately 10 meters/second. A further factor improving the spherical shape of the particles.

Figure 4:
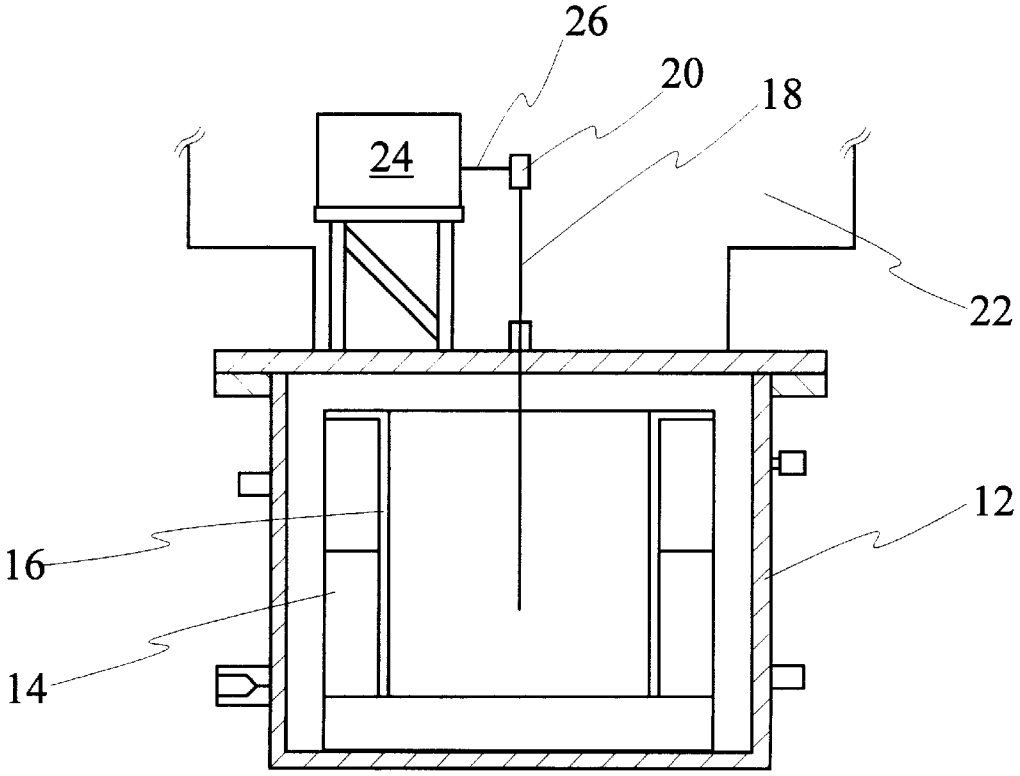
FIG. 4 is a schematic illustration of the containment vessel of the apparatus of FIG. 1, shown in greater detail.

The containment vessel 12 is seen in greater detail in FIG. 4. Furnace 14 surrounds a central crucible 16. Transfer tube 18 carries molten material to the nozzle 20. Filtering of the molten material within the containment vessel may be necessary to prevent the blockage of the nozzle 20 with oxide particles or other impurities. A stainless steel mesh, for example, is positioned over the intake of the transfer tube 18 in the containment vessel 12. The one or more apertures 21 comprising capillaries or orifices, in the nozzle 20 are disposed at a small angle to vertical to control the trajectory shape and prevent collision of droplets on rising and falling paths. Vibration unit 24 includes an acoustic vibration transducer such as a speaker coil which provides controlled frequency and amplitude vibration through a physical connection such as a connecting rod 26 to the nozzle 20. This connection imparts a vibration transverse to the direction of flow of the fluid stream. The small angle to the vertical remains substantially unchanged during vibration to maintain control of the droplet trajectories. The Rayleigh wave disturbance technique is well known for causing ordered instability of a fluid stream resulting in controlled droplet size. Vibrations have also been applied to the fluid or the receiving atmosphere in the prior art for the production of controlled droplet size. The fluid stream is depicted at arrow F and the oscillation at arrow V in FIG. 5. Using Rayleigh wave instability, the nozzle is vibrated at a prescribed frequency and amplitude to control the distribution of particle sizes.

Transverse oscillation of the nozzle 20 creates a liquid stream which retains a controllable trajectory profile, even after breakup into particles. This is beneficial whether or not a Rayleigh wave instability is induced. The fluid stream is released from continuously changing positions, launching sequential droplets on different trajectories. This helps prevent particles colliding or coalescing. Control of the rate of oscillation and displacement of the nozzle through modulation of the amplitude can ensure that each droplet within a critical time period in a cooling chamber travels on a unique parabolic trajectory. When a droplet exhibits a unique trajectory relative to its neighbors, the probability of inter-particle collisions is reduced. Avoiding inter-particle collisions is important in obtaining uniform particles.

Figure 5:
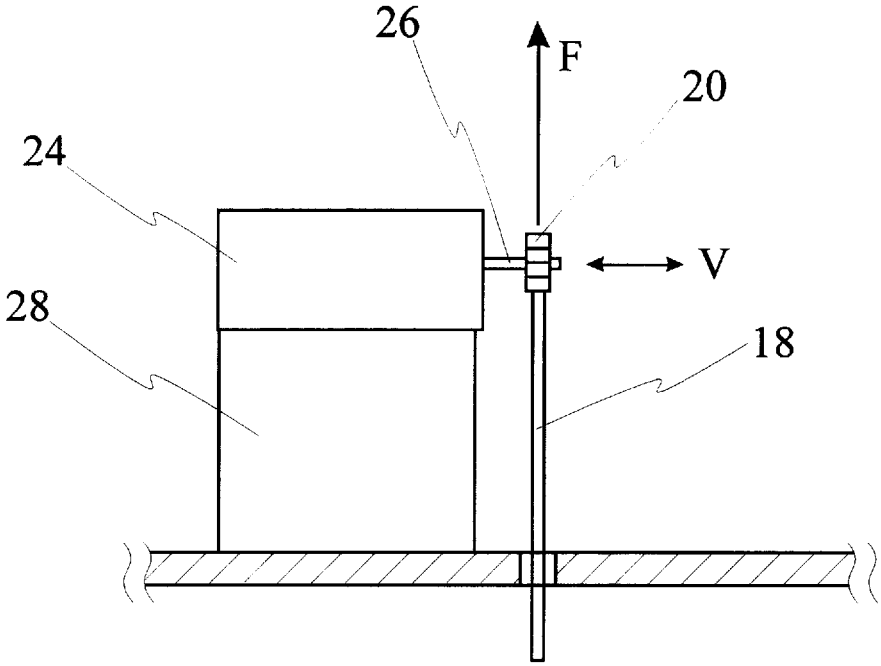
FIG. 5 is a schematic illustration of a single orifice nozzle of the apparatus of FIG. 1, shown in greater detail.

FIG. 5 offers a more detailed view of a single orifice nozzle and vibration unit. The vibration unit 24 is mounted on a support 28 above the containment vessel 12 to dampen unwanted transmission of vibrations. Seen in greater detail in FIG. 6, a nozzle 20 is depicted having two apertures 21. The one or more apertures 21, may be in the form of an orifice or a capillary. For the formation of large particles, the use of a capillary nozzle does not experience problems due to excess flow resistance. Advantageously, the use of a capillary nozzle is convenient for the application of a Raleigh wave disturbance to the fluid stream. As illustrated, each aperture 21 is directed at a small angle to the vertical. The angle determines the distance of final impact from the nozzle. It is desired to prevent descending droplets from colliding with newly formed droplets. At the same time the trajectory cannot be broader than the cooling chamber 22, or the droplets would impact prematurely with the sides of the chamber 22. With modification to the shape of the chamber 22, multiple nozzles 20 can also be provided in the same cooling chamber 22.

Vibrations imparted from the vibration unit 24 to the nozzle 20 cause both the Raleigh wave disruption and lateral displacement of the trajectories of sequential droplets. The lateral displacement, determined by the amplitude of the vibrations, causes the nozzle to oscillate from side to side. With the apertures carefully arranged, the small angle to the vertical determining the parabolic shape of the trajectories is generally unchanged. Further, apertures 21 must be arranged, for instance as illustrated on opposite sides of the nozzle 20, to prevent the oscillation from causing collision between trajectories of droplets from the plural apertures 21. As discussed earlier, other means are known which could be used for imparting wave disturbance to the fluid stream, such as to the surrounding gas, or to the molten fluid. Also other means are known which could be used for separating droplet trajectories to prevent agglomeration or collision, such as applying a charge to the droplets, or by directing the droplets with a dispersing flow. Conveniently, the transverse vibrations provide both a means for disrupting the fluid stream into uniform droplets and a means for separating or dispersing trajectories of sequential droplets from a single nozzle.

A further embodiment of the invention is illustrated in FIGS. 7 and 8 including a substantially cylindrical elongated cooling chamber 22 containing a plurality of nozzles 20 arranged in parallel from a seamless interconnecting tube 42. An orifice 40 associated with each nozzle 20, releases a cooling plume of argon vapor substantially transversely toward each molten stream. A trajectory 32 is illustrated in FIG. 8. The angle of the nozzle determines the horizontal breadth $x_{max}$ of the trajectory. Pressure in the containment vessel 12 can be adjusted to control the trajectory height $y_{IS}$. The argon plume impacts the molten stream below the trajectory azimuth, as illustrated in FIG. 8. The cooling chamber is maintained at slightly higher than atmospheric pressure. A continuous circulation of argon is maintained to control the temperature within the cooling chamber 22. In addition, the expansion of the argon to gas phase displaces lighter oxygen and nitrogen which might have leaked into the chamber 22. The cooling chamber 22 in this embodiment has a substantially circular cross-section. As a result the trajectories can be directed so that particles impact a lower portion of the chamber at an angle less than perpendicular which should further reduce the force on impact. Collection of the formed particles and cooling gas evacuation is illustrated through a collection outlet 44.

An atomization trial was conducted for the magnesium alloy AZ91D. The magnesium, which has a melting temperature of 595 degrees C, was heated in the containment vessel to a temperature of 650 degrees C. The pressure of the containment vessel was raised to 80 kPa (12 psi) above atmospheric, which generated an inverted stream about 130 cm high in an atmosphere of argon gas. A plume of argon gas and vapor was made to impinge on the inverted stream in an orthogonal direction. The argon injection nozzle was 50 cm away from the upward portion of the stream trajectory. The cooling chamber was maintained at approximately 5 kPa (0.7 psi) above atmospheric pressure. The nozzle contained a 0.5 mm diameter orifice. No vibration was applied. The resulting particles were near-spherical, and the majority of granules collected were between 1.00 and 1.70 mm in diameter. The granules exhibited a silver color indicative of substantially no oxide layer.

Of course, numerous other embodiments may be envisaged, without departing from the spirit and scope of the invention as defined in the appended claims.

What is claimed is:

1. A method of forming particles of at least nearly spherical shape in an atomization apparatus comprising the steps of:

releasing a stream of molten material through an aperture under positive pressure upward into a cooling chamber where the stream breaks up into substantially spherical droplets; and dispersing trajectories of sequential droplets to reduce the incidence of collisions between droplets;

whereby the stream is released under sufficient pressure that the droplets have a kinetic energy sufficient to follow an upward trajectory above the aperture and a descending return path with a duration sufficient to harden the material to a point where the droplet shape will not be substantially changed on impact with a collecting area of the cooling chamber.

2. A method as defined in claim 1, further including the step of impinging the upward trajectory of the stream with a flow of partially or fully vaporized liquid and gas coolant.

3. A method as defined in claim 2, wherein the coolant further includes a fine solid phase material for incorporation with the molten material.

4. A method as defined in claim 2, wherein the coolant comprises a mixture further including a protective gas or a gas for promoting mass transfer.

5. A method as defined in claim 2, wherein the coolant comprises one or more gasses selected from the group consisting of: argon, nitrogen, helium, and carbon dioxide.

6. A method as defined in claim 5, wherein the flow of coolant impinges the upward trajectory of the stream below the azimuth of the trajectory.

7. A method as defined in claim 1, wherein the step of dispersing trajectories comprises applying vibrations to the aperture transverse the direction of the molten stream for causing lateral displacement of the aperture, thereby releasing sequential droplets on differing trajectories.

8. A method as defined in claim 7, wherein the vibrations are further adapted to induce a Rayleigh wave instability to the molten material for breaking up the stream into substantially uniform droplets.

9. A method as defined in claim 1, wherein the descending return path comprises at least a portion of a height of the upward trajectory.

10. An atomization apparatus for the formation of particles of at least nearly spherical shape from molten material comprising:

a vessel for containing a material at a molten state;

pressurization means for applying positive pressure to at least a portion of the molten material in the vessel;

a cooling chamber;

at least one aperture contained in the cooling chamber communicating with the vessel for releasing a stream of the molten material under pressure upwards into the cooling chamber where it will break up into substantially spherical droplets;

the cooling chamber further including a top above the at least one aperture dimensioned to permit each of the droplets released to follow an upward trajectory and to fall on a return path to a collection area of the cooling chamber, the collection area being disposed below the top of the cooling chamber, for collecting the formed particles; and means for dispersing the trajectories of sequential droplets.

11. An atomization apparatus as defined in claim 10, wherein the means for dispersing trajectories of sequential droplets comprises a vibration unit for applying vibrations to the at least one aperture transverse to the direction of the stream for laterally displacing the aperture.

12. An atomization apparatus as defined in claim 11, wherein the vibration unit for applying transverse vibrations to the at least one aperture is further adapted to induce a Rayleigh wave instability for causing the break up of the stream into substantially uniform droplets.

13. An atomization apparatus as defined in claim 11, wherein the at least one aperture is disposed at a small angle to a substantially vertical position.

14. An atomization apparatus as defined in claim 13, wherein the at least one aperture comprises a nozzle comprising one or more capillary apertures.

15. An atomization apparatus as defined in claim 13, wherein the vibration unit imparts vibrations of selected frequency and amplitude for breaking up the stream into substantially uniform droplets of selected size.

16. An atomization apparatus as defined in claim 15, wherein the amplitude of the vibrations also controls the lateral displacement of the at least one aperture.

17. An atomization apparatus as defined in claim 10, wherein the cooling chamber includes an orifice for introducing a plume of vapor and gas coolant to impinge on the molten stream.

18. An atomization apparatus as defined in claim 17, wherein the coolant comprises one or more liquefied gases or a mixture of one or more liquefied gasses.

19. An atomization apparatus as defined in claim 18, wherein the coolant comprises a mixture further including a protective gas or a gas for promoting mass transfer.

20. An atomization apparatus defined in claim 18, wherein the coolant further includes a fine solid phase material for incorporation with the molten material.

21. An atomization apparatus as defined in claim 18, wherein the coolant comprises one or more gasses selected from the group consisting of: argon, nitrogen, helium and carbon dioxide.

22. An atomization apparatus as defined in claim 21, wherein a controlled atmosphere is maintained above atmospheric pressure within the cooling chamber.

23. An atomization apparatus as defined in claim 17, further comprising a plurality of nozzles within the cooling chamber configured to avoid impingement among of a plurality of droplet trajectories from the plurality of nozzles and a plurality of orifices for introducing a plume of vapor and gas coolant to impinge on a molten stream from each nozzle.

* * * * *